US006135743A

United States Patent [19]

Keikov et al.

[11] Patent Number: 6,135,743

[45] Date of Patent: Oct. 24, 2000

[54] ROTARY PISTON PUMP

[76] Inventors: Jūri Keikov, Virmalise 5 - 26, EE0001 Tallinn; Ilja Keikov, Kopli 100c - 29, EE0017 Tallinn, both of Estonia

[21] Appl. No.: 09/117,903

[22] PCT Filed: Dec. 13, 1996

[86] PCT No.: PCT/EE96/00003

§ 371 Date: Mar. 1, 1999

§ 102(e) Date: Mar. 1, 1999

[87] PCT Pub. No.: WO98/26182

PCT Pub. Date: Jun. 18, 1998

[51] Int. Cl.[7] ..... F04C 18/00

[52] U.S. Cl. ..... 418/195; 418/68

[58] Field of Search ..... 418/195, 68

[56] References Cited

U.S. PATENT DOCUMENTS

| | | | |
|---|---|---|---|
| 2,678,003 | 5/1954 | Gerken | 418/195 |
| 2,727,465 | 12/1955 | Dutrey . | |
| 4,021,158 | 5/1977 | Bajulaz | 418/68 |

FOREIGN PATENT DOCUMENTS

| | | | |
|---|---|---|---|
| 703216 | 1/1952 | United Kingdom . | |
| WO 94/18434 | 8/1994 | WIPO | 418/195 |

*Primary Examiner*—Thomas Denion
*Assistant Examiner*—Thai-Ba Trieu
*Attorney, Agent, or Firm*—Birch, Stewart, Kolasch & Birch, LLP

[57] ABSTRACT

This invention may find use in applications such as pumps and other machines, it solves the problem of reduction of hydrodynamic resistance multiply and increases the capacity. The offered mechanim comprises of disc-shaped housing (1) with through hole (2), which is overlapped by mobile parts of rotary-piston group. Four chambers (6), formed by rotor (5) and pistons (11, 12), move in a circle inside the housing hole (2) in the plane of axle of the hole and run alternately along two sides of the housing. On running along one side they increase their volume, and along the other they reduce it, pumping over fluid through the said hole (2) in the housing. A rotary-piston group kinematically represents a modified Hooke joint. Shafts (4) are positioned at an angle. Sleeves of forks are changed into single arc-shaped half-sleeves, which are located directly on the shafts (one sleeve on each shaft). Cruciform has a spherical shape with two intersected circular canals and functionally the cruciform represents a rotor of the rotary-piston mechanism. Half-sleeves of shafts, located in the cruciform canals, functionally represent doubled pistons (11, 12). Inner surface of the through hole (2) in the housing and outer surface of members of the rotary-piston group (5, 11, 12) have spherical shape.

1 Claim, 2 Drawing Sheets

ROTARY PISTON PUMP

Figure 1:
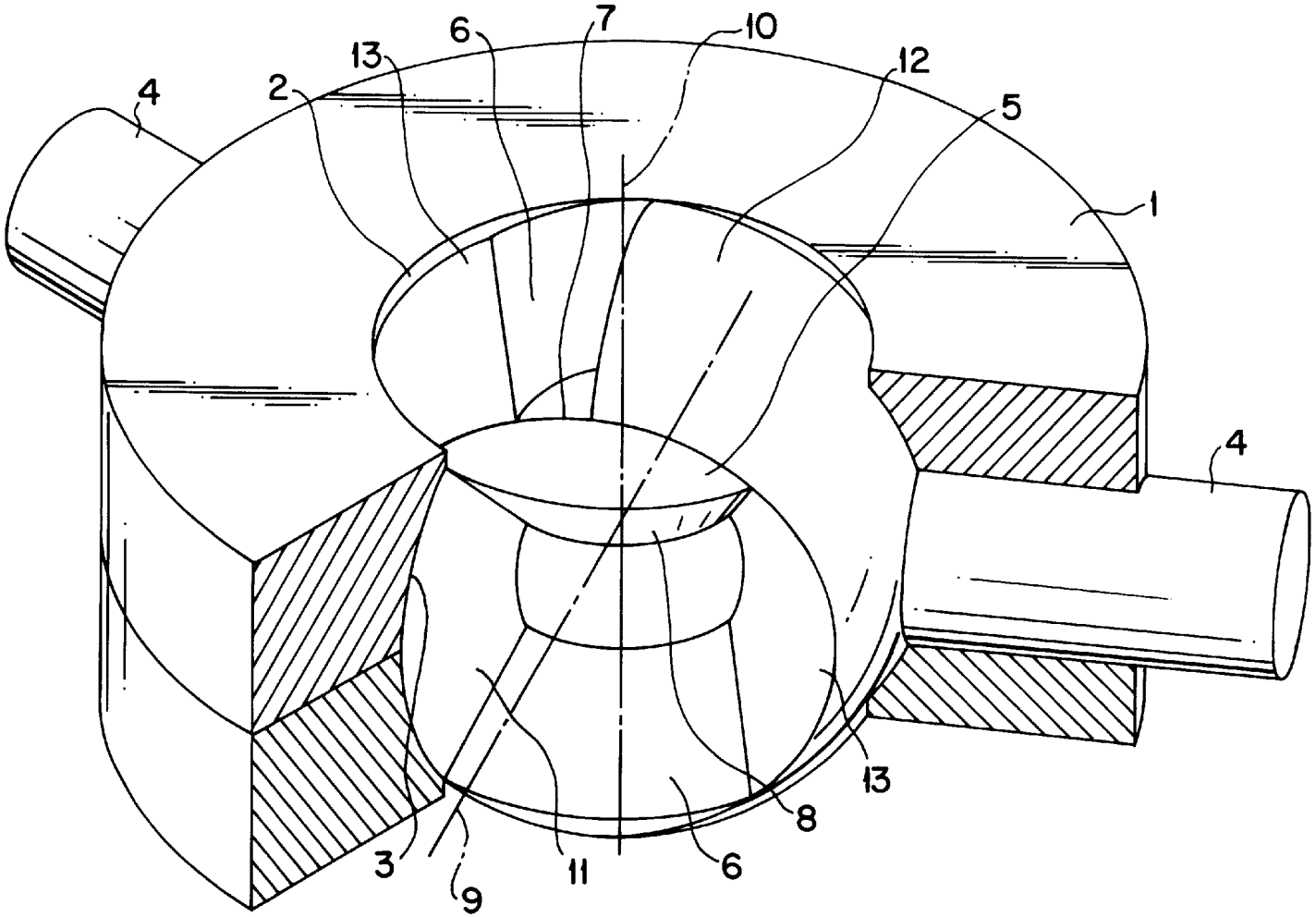

This application is the national phase under 35 U.S.C. §371 of prior PCT International Application No. PCT/EE96/00003 which has an International filing date of Dec. 13, 1996 which designated the United States of America, the entire contents of which are hereby incorporated by reference.

This invention relates to mechanical engineering and may found use in applications such as pumps and other machines using varying-capacity working chambers. Of the rotary-piston mechanisms with varying-capacity chambers, practical use has a Wankel mechanism. One of its disadvantages is a need for counterbalances mounted on rotor-carrying shaft because while rotating, shaft's center-of-gravity moving along the circular trajectory.

It is known a rotary-piston mechanism (Spherical engine with rotating pistons, Japan pat. claim No 4744565 class 51 B 61, F01 C 3100, pub. in 1972) with all parts' centers-of-gravity staying motionless during the work. Structurally it is designed in the form of a housing with a spherical chamber accommodating a Hooke joint having shafts mounted at an angle with respect to each other. Cruciform of the joint is designed in the form of a disk and forks of shafts' have the form of a half-disks. Surfaces of the forks and the cruciform define four working chambers with capacity changing twice per revolution. Said mechanism has following disadvantages: pairwise-parralel character of working chambers' following with one pair of chambers' 90 degrees phase of rotating shift relative to another and their shape, as a result of which every chamber's cavity extending about 180 degrees in direction of rotation. For this cause diametrical plane of spherical chamber of housing where shafts' axles of symmetry are located and intersecting, at every moment of time is threaded by cavities of two or four working chambers. It principally limits possibilities to reduce a hydrodynamic resistance of this mechanism.

The present invention aims to reduce hydrodynamic resistance multiply.

This goal may be achieved by giving to a housing a shape of disc with through hole with field that is not threaded by cavities of working chambers of rotary-piston group because its design is based on modified Hooke joint.

In known Hooke joint each one of two cruciform's axles is connected with shaft's fork by two articulated joints. Members of articulated joint are located: two sleeves on each shaft's fork and two journals on the end faces of each cruciform's axle. This rotary-piston mechanism is based on kinematic scheme of a Hooke joint. In accordance with this scheme both cruciform's axles have one journal of articulated joint each, that are located in the central parts of axles' of crusiform, spatially integrated and joined each with one sleeve of cruciform and said sleeves are designed as arc-shaped half-sleeves. Cruciform has spherical shape. Journals of articulated joints of axles' of said cruciformwith with shafts' has concave shape of rotating. Intersecting in two diametrically opposite places they girdle spherical contour of the cruciform along the diametrical lines in planes that are positioned at an angle with respect to each other. Arc-shaped half-sleeves are formed by outer spherical surface and by inner spherical surface of rotating that repeats inner concave surface of rotating and is complementary to it and by surface of longitudinal section of sleeve. Cruciform and arc-shaped half-sleeves are located in through hole of disc-shaped housing and inner surface of said hole has shape of spherical belt with instant or varying width.

Cruciform accommodates 4 chambers, each of them defines by one of two concave cruciform's surfaces of rotating; by part of concave complementary surface of rotating of one arc-shaped half-sleeve; by surface of longitudinal section of another sleeve and by inner surface of inner spherical belt of through hole in the housing.

Character of chambers' following during the rotation is sequential and cavity of every chamber in direction of rotation extending little less than 90 degrees. For this reason diametrical plane of inner spherical surface of through hole in housing, where shafts' axles of symmetry are located and intersecting for four moments per revolution is not threaded by cavities of cambers of rotor-piston group because it is overlapped by members of rotary-piston group. If mentally substitute diametrical plane by thin disc with outer spherical surface, four moments of overlapping transformes into four phases of overlapping per revolution of rotor-piston group. Mentally increasing thickness of spherodisc, phases of overlapping also increasing and linking up when width of spherodisc and width of piston became equal. Spherodisc of such thickness is not threaded by cavities of chambers at all, and is overlapped by members of rotary-piston group constantly. Thereby, the field of through hole of disc-shaped housing is not threaded by cavities of chambers of rotary-piston group when minimal width of inner spherical belt of through hole in housing is comparable with width of piston. Practically, width of disc-shaped housing may be within the limits of the piston of rotary-piston group as well.

In the considered rotary-piston mechanism the diameter of the through hole in a disc-shaped housing is comparable with the width of the said housing that causes large reducing of hydrodynamic resistance in comparison with the prototype. In accordance with technological, operational or other requirements, outer shape of the housing may distinguish from disc.

In the FIG. 1 design of the rotary-piston mechanism for use as a pump is shown.

Figure 2:
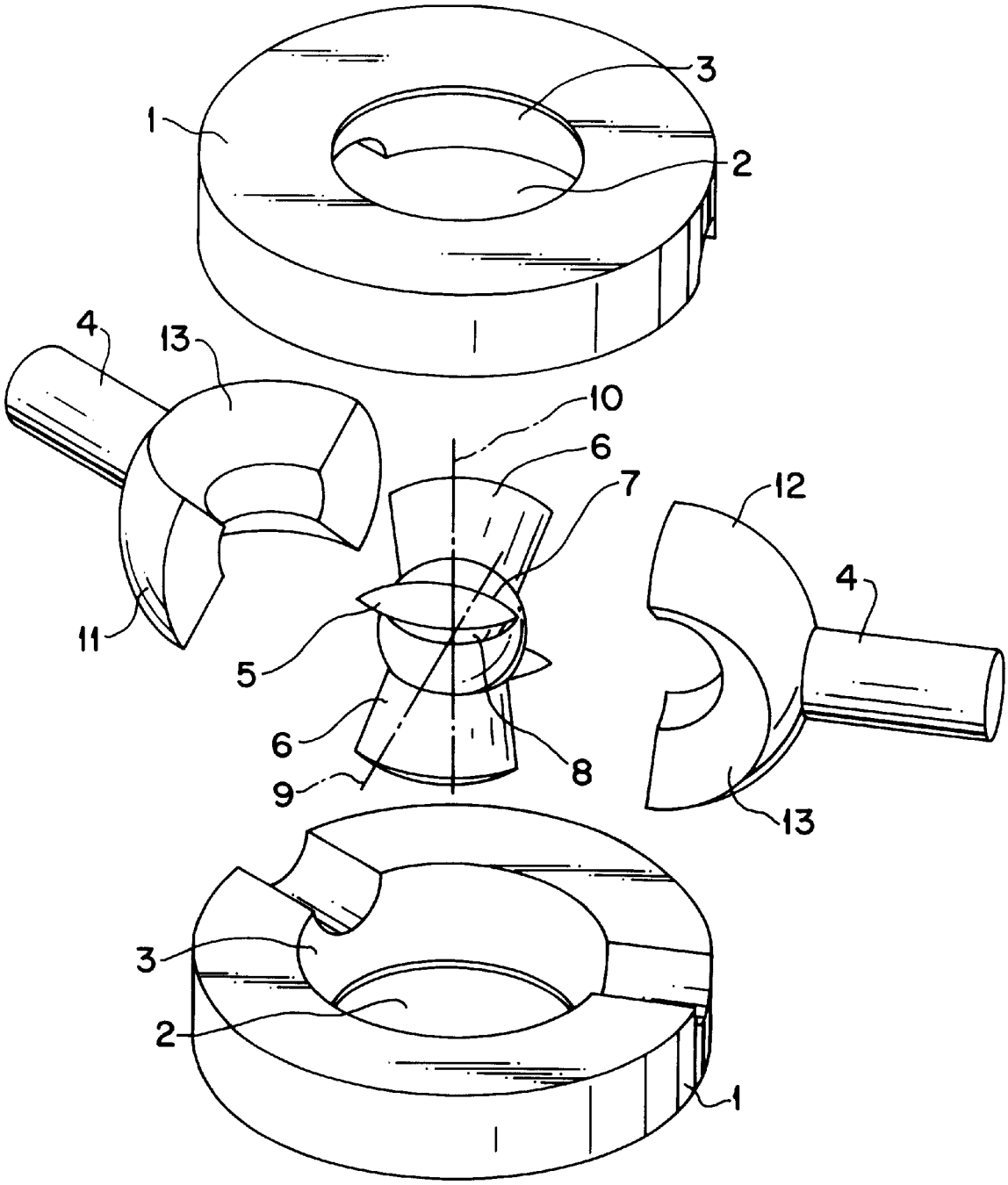

In the FIG. 2 a group of parts of the rotary-piston mechanism is presented.

The offered rotary-piston mechanism comprises disc-shaped housing (1) with through hole (2), inner surface of which (3) has shape of spherical belt, two shafts (4) positioned at an angle with respect to each other and directed inwards of said housing, and rotary-piston group mounted on shafts and located within of said through hole. Rotor (5) carries inside four chambers (6) and kinematically represents a cruciform. Chambers of said rotor are defined by two concave surfaces of rotating (7) and (8) that kinematically represent journals of articulated joints of two axles of cruciform (9) and (10) with shafts. Journal (7) belongs to axle (9) of cruciform and journal (8) belongs to axle (10). Two arc-shaped half-sleeves (11) and (12) of two articulated joints are located on the shafts perpendicular to their axles (one sleeve on each shaft) and represent doubled pistons of four chambers of said rotor. Capacity of chamber in direction of pistons' movement is limited from the side, opposed to the piston, by surface of second doubled piston (13) that overlaps the said chamber in the lateral direction. During the shafts' movement, each piston of the rotary-piston group is moving along the said chamber of the rotor, changing its capacity twice per revolution. Direction of forcing fluid through the said hole depends from the direction of rotation of shafts of rotary-piston group.

What is claimed is:

1. In a rotary-piston mechanism including, a housing with a spherical chamber, accommodating a rotary-piston group, configured as a modified Hooke joint, shafts of the joint being directed towards the interior of the housing, shafts of the joint, perpendicular to axes thereof, being mounted in sleeves with articulated joints in a cruciform, having a spherical shape, parts of articulated joints of its axes with shafts being located in the central part of the cruciform, one on each axis, the parts having the shape of concave surfaces of a rotating girdling spherical contour of the cruciform along diametrical lines in planes positioned at an angle with respect to each other and accommodating the sleeves of the shafts, the sleeves of the shafts being arc-shaped half-sleeves, and the cruciform functionally representing a rotor of the rotary-piston mechanism, while the arc-shaped half-sleeves are double pistons of the said mechanism, the improvement comprising:

the housing being shaped as a disc, and said housing being divided into two parts by a plane, defined by axes of the shafts.

* * * * *